US008459670B1

(12) United States Patent
Tizzone

(10) Patent No.: US 8,459,670 B1
(45) Date of Patent: Jun. 11, 2013

(54) COMPACT FOLDING LONG BOARD

(76) Inventor: Vincenzo Tizzone, Edmond, OK (US)

( * ) Notice: Subject to any disclaimer, the term of this patent is extended or adjusted under 35 U.S.C. 154(b) by 50 days.

(21) Appl. No.: 13/373,350

(22) Filed: Nov. 10, 2011

(51) Int. Cl.
*B62M 1/00* (2010.01)

(52) U.S. Cl.
USPC ..... 280/87.042; 280/87.05

(58) Field of Classification Search
USPC ..... 280/87.041, 87.042, 87.043, 87.05, 280/14.21, 8, 15, 18, 20
See application file for complete search history.

(56) References Cited

U.S. PATENT DOCUMENTS

| | | | | |
|---|---|---|---|---|
| 4,195,857 | A | 4/1980 | Hechinger | |
| 5,505,474 | A | 4/1996 | Yeh | |
| 5,540,455 | A | 7/1996 | Chambers | |
| 6,053,513 | A | 4/2000 | Dickinson | |
| 6,131,931 | A | 10/2000 | Globerson | |
| D505,470 | S | 5/2005 | Hong | |
| 7,150,461 | B2 | 12/2006 | Schnuckle | |
| 7,425,017 | B2 | 9/2008 | Mash | |
| D633,584 | S | 3/2011 | Hong | |
| 7,976,034 | B1 | 7/2011 | Hong | |
| 8,186,693 | B2 * | 5/2012 | Kortschot | 280/11.19 |
| 8,226,096 | B2 * | 7/2012 | Reyes, Jr. | 280/87.042 |
| 8,251,378 | B2 * | 8/2012 | Van Dyke | 280/20 |
| 8,371,590 | B2 * | 2/2013 | Kortschot | 280/11.19 |
| 2002/0089137 | A1 * | 7/2002 | Chang et al. | 280/87.041 |
| 2002/0117824 | A1 * | 8/2002 | Godfrey | 280/87.05 |
| 2003/0127816 | A1 * | 7/2003 | Schnuckle et al. | 280/87.042 |
| 2004/0046363 | A1 * | 3/2004 | Emanuele et al. | 280/603 |
| 2005/0212246 | A1 | 9/2005 | Hong | |
| 2007/0029749 | A1 * | 2/2007 | Gregory et al. | 280/87.042 |
| 2008/0157495 | A1 * | 7/2008 | Choi | 280/87.042 |

* cited by examiner

*Primary Examiner* — Hau Phan
*Assistant Examiner* — Bridget Avery
(74) *Attorney, Agent, or Firm* — Randal D. Homburg

(57) ABSTRACT

A long board for street skating having an offset axial joint with a lower hinge support block on a front segment and a lower hinge support block on a rear segment having a hinge which folds the board in the direction of the upper surfaces of each segment, the offset joint allowing a first set of wheels to set behind a second set of wheels depending from each segment when in a folded position for a more compact profile, each lower hinge support block providing the hinge so that each front and rear segment are parallel in a stored and folded position.

6 Claims, 5 Drawing Sheets

COMPACT FOLDING LONG BOARD

CROSS REFERENCE TO RELATED APPLICATIONS

None.

I. BACKGROUND OF THE INVENTION

1. Field of Invention

A long board for street skating having an offset axial joint with a lower hinge support block on a front segment and a lower hinge support block on a rear segment having a hinge which folds the board, the offset joint allowing a front set of wheels to set behind a rear set of wheels in a folded position for a more compact profile, each lower hinge support block providing the hinge so that each front and rear segment are parallel in a stored and folded position. In furtherance, the lower hinge support block may be provided with at least one locking pin inserted through common longitudinal bores of at least one bore channel through the lower hinge locking blocks in an elongated position. Still further, where there are two locking pins, the locking pins may be joined by a common wire or strap to maintain the pins together and also to provide a carrying handle for the board where the board is folded and the pins are inserted into to longitudinal bores while in the folded position.

2. Description of Prior Art

A preliminary review of prior art patents was conducted by the applicant which reveal prior art patents in a similar field or having similar use. However, the prior art inventions do not disclose the same or similar elements as the present folding long board, nor do they present the material components in a manner contemplated or anticipated in the prior art.

Several skateboard patents are disclosed by an inventor named Thomas K. Hong, as indicated in U.S. Pat. No. 7,976,034, and two design patents, D633584 and D505470. A base patent was filed and published as Application pub. No. 2005/02122465. In the issued patent and the two design patents, a folding skateboard is disclosed which has a front deck, a center deck and a rear deck attached by two respective hinges, all of which fold the board where each upper surface of each deck is folded towards each other. In the published application, in paragraph [0045] to [0051], a skateboard is disclosed having a front board portion and a rear board portion attached by a single hinge directly attached to each front and rear board section on the upper surfaces of the board sections with the board being folded "with top surface 251 of the front board portion 250 facing the top surface 251 of the rear board portion 250." Referenced claims in that application directed towards the bi-folding skateboard are claims 13-20. Reference is made to a FIG. 9 of that application, but FIG. 9 does not actually show what is referenced within the above noted paragraphs, which is perhaps the reason why that subject matter was not included in the final issued patent '034 nor were any of the related claims included in the issued patent.

In U.S. Pat. No. 6,131,931 to Globerson, a folding skateboard is disclosed which is divided into three sections, on section measuring about half the length of the skateboard, a middle section measuring the height of the truck and wheel assembly, and a third section constituting the remaining length of the skateboard, where the folded position provides the wheel assemblies offset to where there is no contact. This skateboard also provides a carrying strap 36. The skateboard is locked into position by several locking devices, including side support members attached to the side margins of the board in the elongated position, as well as rods slid within cut grooves along the linear axis of the board.

A spring articulating skateboard is shown in U.S. Pat. No. 5,540,455 to Chambers which has a front section and rear section attached by a spring, which allows the skateboard to pivot up and down at the joint between the front and rear section. This board, however, appears to be incapable of being folded for a stored position and appears to be prone to exist in the elongated position at rest. U.S. Pat. No. 4,195,857 to Hechinger has a folding tail fin and U.S. Pat. No. 5,505,474 to Yeh folds into three section in a sideways configuration as shown within that patent.

II. SUMMARY OF THE INVENTION

Long boards are a four wheeled device utilized primarily for transport purposes and have regained popularity on college campuses for student transport. They tend to differ by having a longer length and greater weight than a skateboard, the skateboard being primarily intended for tricks and acrobatic maneuvers, which would require an extremely sturdy and flexible board to withstand the great force impact which accompany these acrobatic transport devices. The more docile long boards are generally longer than a skateboard and often quite a bit more heavy and utilized mainly on smooth flat surfaces, like sidewalks and streets, much like the original sidewalk surfboards of the 1960's era.

These long boards, being generally heavier and of a length of 40" on the average, are difficult to carry and store while not in use, especially when used for student transport on a campus. Therefore, enabling these long boards to be folded for more compact carrying and concealment within a backpack would be a useful function. However, by creating a folding embodiment, there is a tendency to weaken the structure of the long board, which lessens its usefulness as a transport ground device upon which a rider may securely ride. The present board provides a long board with the ability to fold into a compact embodiment and easily fold out into a useable long board for transport, with the elongated board providing the hinge set upon hinge support blocks which serve three purposes. The first purpose is to provide the elongated embodiment with enhanced structural support by being abutted when the long board is extended into the elongated position. The second purpose is to provide the long board with the ability to be folding with the bottom surfaces directed towards each other, but with the front wheels against the lower surface of the rear board section, the rear wheels against the lower surface of the front board section, with the front and rear wheels being offset in a folded position where they do not touch each other in the folded position. A third purpose of the hinge support blocks is to provide a structural support matrix for at least one common longitudinal bore in the front hinge support block and abutting rear hinge support block for the insertion of a locking pin to maintain the elongated embodiment of the long board while in use.

III. DESCRIPTION OF THE DRAWINGS

The following drawings are submitted with this utility patent application.

IV. DESCRIPTION OF THE PREFERRED EMBODIMENT

Figure 5:
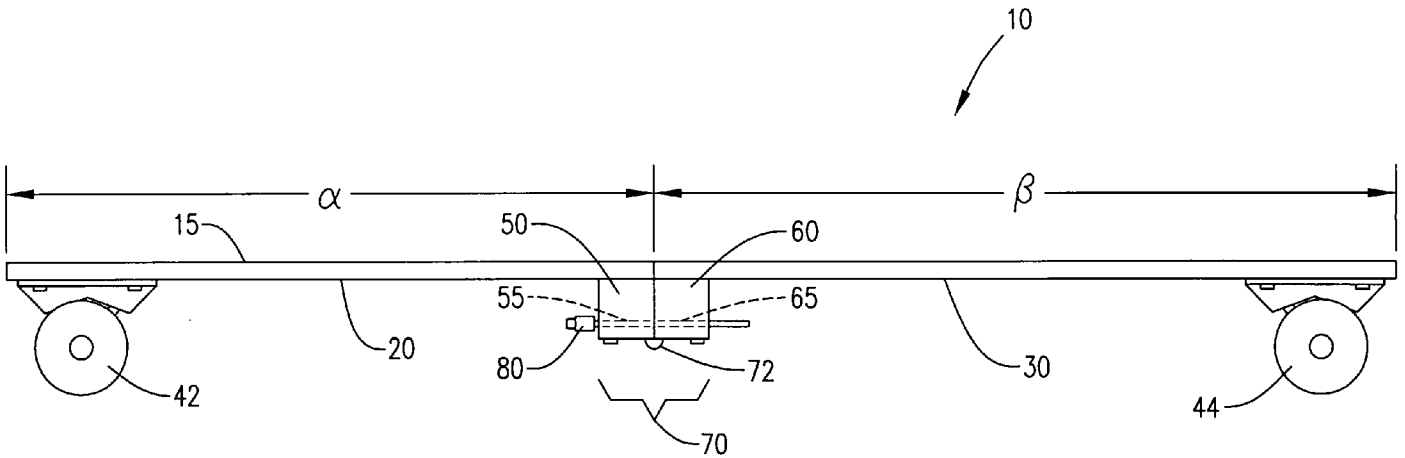
FIG. 5 is a side view of the folding long board in the elongated position.
Figure 6:
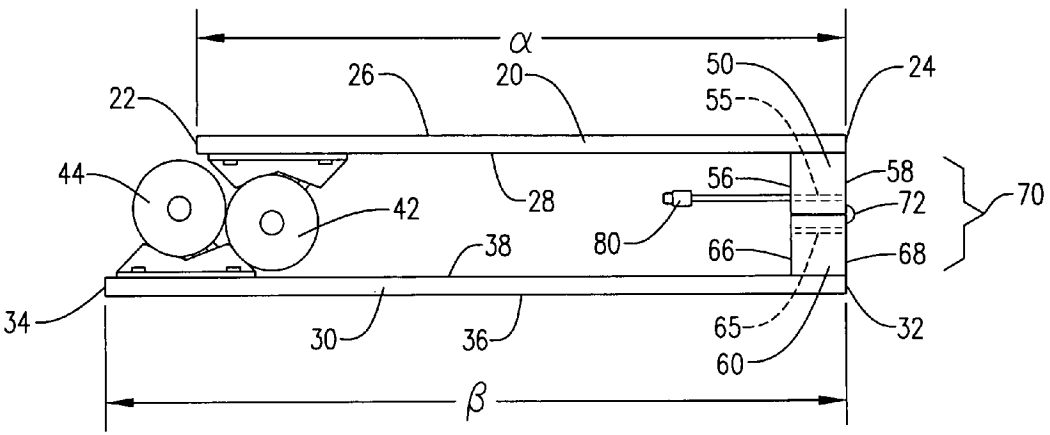
FIG. 6 is a side view of the folding long board in the fully folded position.

A folding long board 10 used to transport a rider on a smooth surface, as illustrated by example in FIGS. 1-6 of the drawings, the long board 10 comprising a front section 20 having a front end 22, a rear joint margin 24, an upper surface 26 and a lower surface 28, and a rear section 30 having a front joint margin 32, a rear end 34, an upper surface 36 and a lower surface 38, the front section 20 further providing a wheel assembly 42 attached to the lower surface 28 near the front end 22 and a lower hinge support block 50 defining a bottom surface 52 and a top surface 54 which is attached to the lower surface 28 of the front section 20 along the rear joint margin 24, and the rear section 30 further providing a wheel assembly 44 attached to the lower surface 38 near the rear end 34 and a lower hinge support block 60 defining a bottom surface 62 and a top surface 64 which is attached to the lower surface 38 along the front joint margin 32, and a hinged joint 70 defining a hinge 72 attached between the bottom surface 52 of the lower hinge block 50 of the front section 20 and the bottom surface 62 of the lower hinge block 60 of the rear section 30, the respective upper surfaces 22, 32 of the front section 20 and rear section 30 defining a contiguous horizontal long board deck 15 in an elongated position, FIG. 5, with the length cc front section 20 and the length β of the rear section 30 being unequal, FIGS. 5-6, so that when the front section 20 and rear section 30 are folded parallel at 180 degrees along the hinge 72 into a folded position, FIG. 6, in the direction of the respective lower surfaces 28, 38, the wheel assemblies 42, 44 of the front and rear sections 20, 30, if attached to their respective lower surfaces at the same distance from the respective ends of each front and rear section, are offset and not in contact, allowing the long board 10 to be folded a full 180 degrees, FIG. 6. The folding long board 10 is incapable of being folded in a direction of the upper surfaces 26, 36 beyond a straight horizontal alignment due to being restricted in that direction by the contact of the rear joint margin 24 of the front section 20 and the front joint margin 32 of the rear section 30, as well as the respective lower hinge support blocks 50, 60 being abutted when the folding long board 10 is extended to an elongated position, FIGS. 1, 2 and 5.

Figure 1:
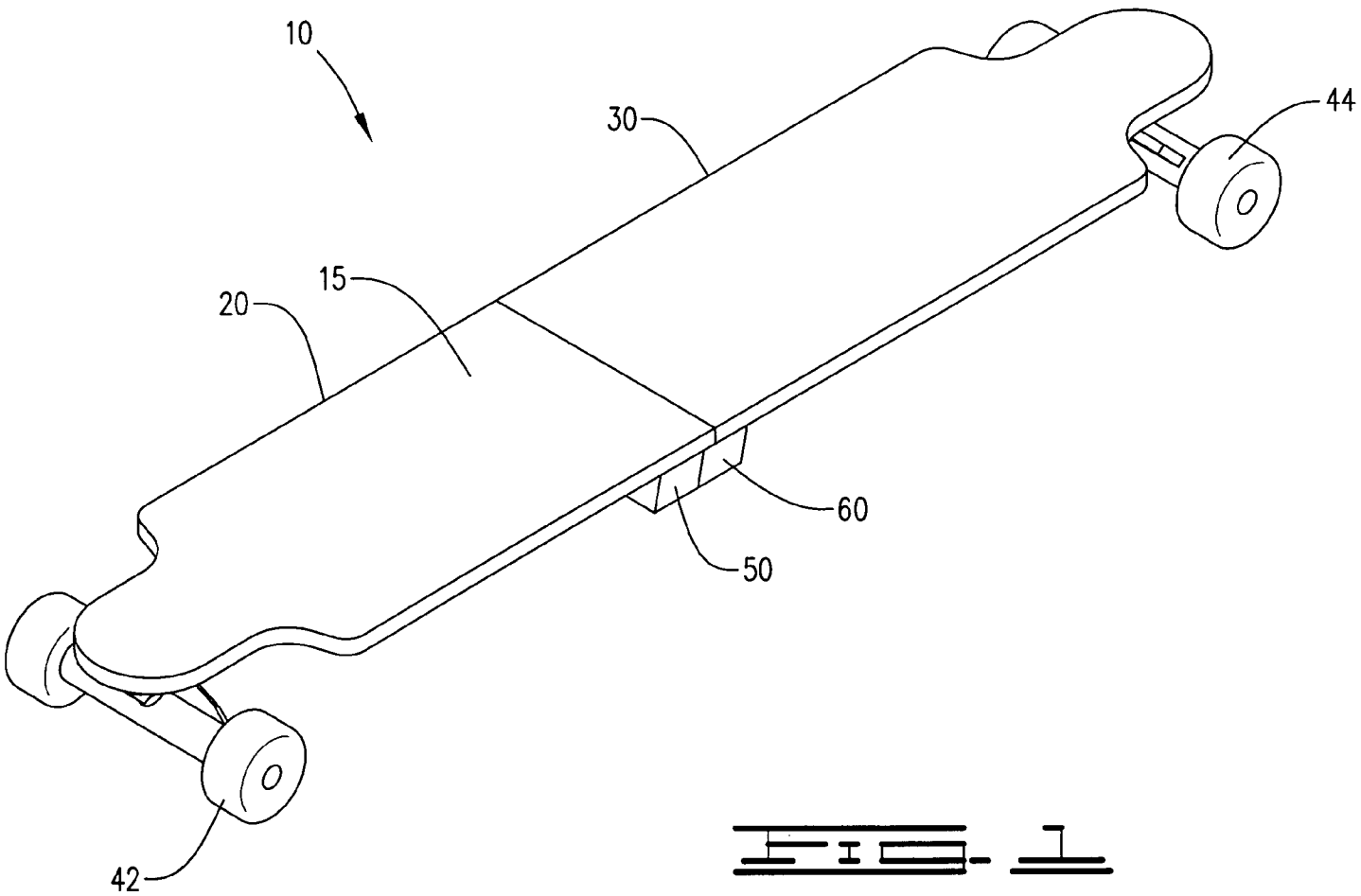
FIG. 1 is an upper perspective view of the folding long board.
Figure 2:
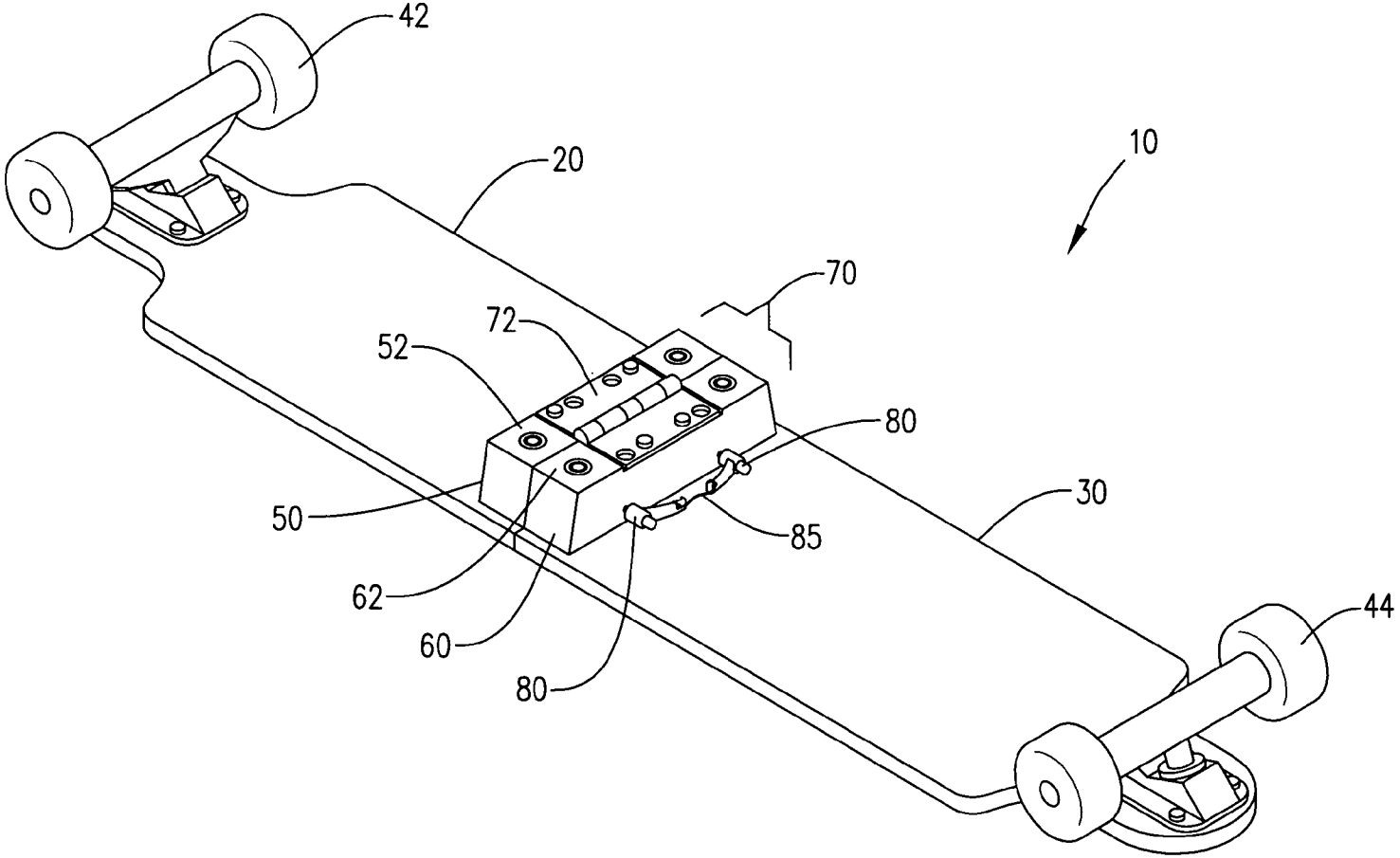
FIG. 2 is a lower perspective view of the folding long board.
Figure 3:
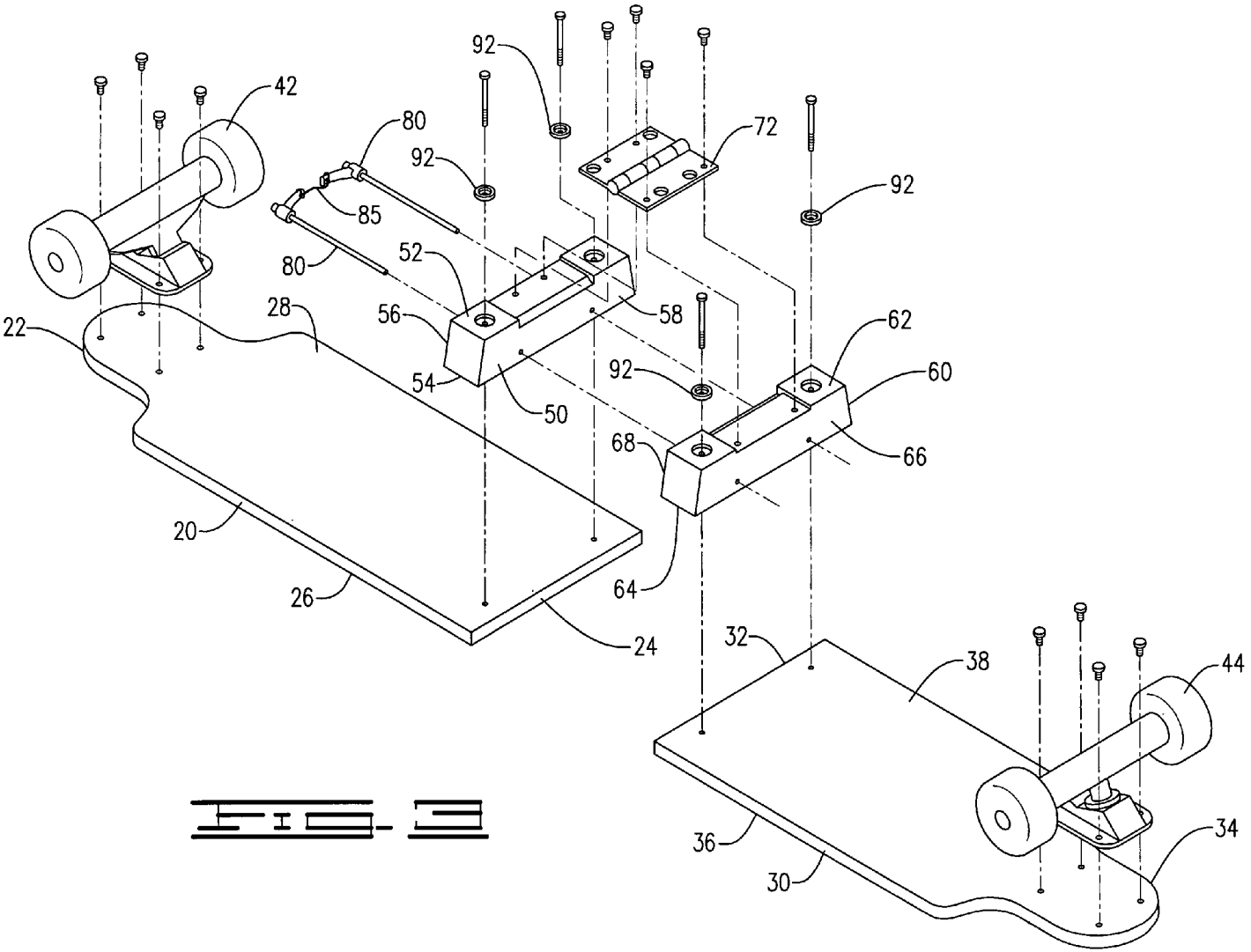
FIG. 3 is an exploded lower component view of the folding long board.
Figure 4:
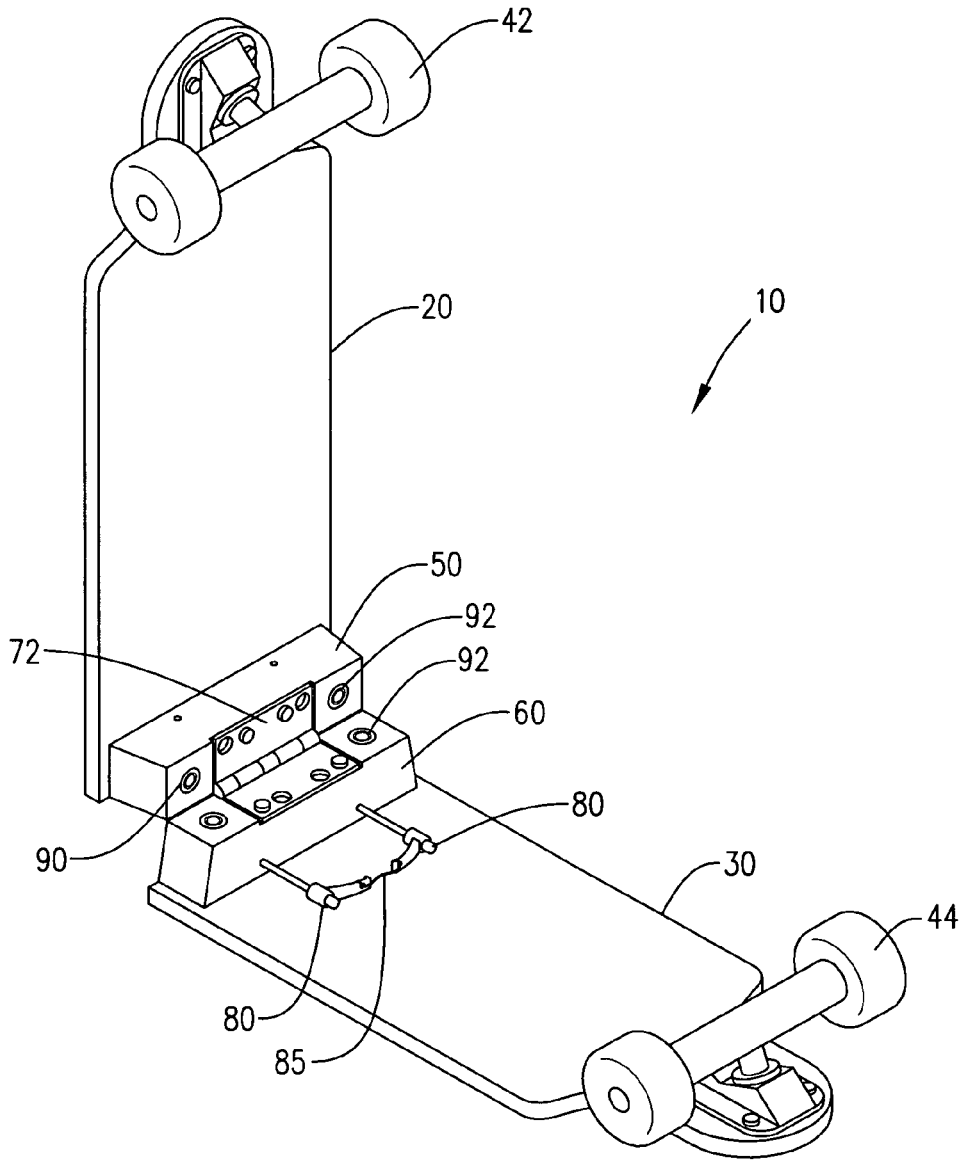
FIG. 4 is a lower view of the folding long board in a partially folded position.

The lower hinge support block 50 on the front section 20 is further defined as having a front surface 56 and a rear abutment surface 58, while the lower hinge support block 60 on the rear section 30 is further defined as having a rear surface 66 and a front abutment surface 68, FIGS. 2-3. The folding long board 10 may further provide the respective lower hinge block 50, 60 each with at least one longitudinal bore 55, 65 which would be in alignment when the folding long board 10 is in the elongated position. Each aligned at least one longitudinal bore 55, 65 of the lower hinge blocks 50, 60 will accept a common locking pin 80 inserted completely through each aligned at least one longitudinal bore 55, 65 to secure the folding long board 10 into an elongated position for use to transport a rider, FIG. 3. After use and the removal of the at least one locking pin 80, the folding long board 10 may be folded in the direction of the lower surfaces 28, 38 into the folded position and transported. It is contemplated that the long board may be provided with a pair of aligned longitudinal bores 55, 65 within the lower hinge blocks 50, 60, providing a pair of common locking pins 80 with a lanyard 85 attached between the pair of common locking pins 80, the lanyard 85 used as a carrying handle for the folding long board 10 in the folded position, FIGS. 2-3.

A significant distinction over the prior art is in the ability to fold the long board 10 in the direction where the lower surfaces 28, 38 of each section 20, 30 are directed towards each other, while providing a full collapse with the wheel assemblies 42, 44 offset folding the long board 10 into a full 180 degree manner using only a single hinge 72, FIG. 6. This is accomplished primarily due to the lower hinge blocks 50, 60 depending from the respective joint margins 24, 32 and further by the abutment of the lower hinge blocks 50, 60, providing a more stabile long board deck 15 in the elongated position and preventing the bending of the front and rear sections 20, 30 in the direction of the respective upper surfaces 26, 36 of each section 20, 30. Thus, in the elongated position, the long board deck 15 does not bend past this horizontal plane under the weight of the rider during use. If there would be any flexibility to the upper surface 26, 36 in the elongated position, it would be due to some inherent flexibility of the materials which form the front and rear sections 20, 30, but not in any way due to the hinged joint 70 at the respective joint margins 24, 36.

In addition, there is some distinction between a skateboard and a long board. General distinctions include the long board being of a longer length than the customary skateboard, the long board being heavier in weight than a skateboard, and the long board provided nearly exclusively for transportation on smooth flat improved surfaces without the wheels leaving the surface while the skateboard is intended for aerial tricks and stunts involving speed, acrobatics and airborne activity which would lead to impact with a surface, thus requiring more flexibility in its use than the long board. The long board appears to be derived from the older sidewalk surfboards and is currently popular on school campuses. Therefore, in providing this folding long board with a compact profile, the folding long board can be more conveniently carried and stored and even placed in some type of carrying bag or book bag. It may also be placed in a compact locker often found in schools which require a smaller profile, the long boards generally being provided in lengths of 36-45 inches in length in the elongated position.

Attachment of the lower hinge blocks 50, 60 to the respective lower surfaces 28, 38 of each section 20, 30 of the folding long board 10 would be by a permanent and durable adhesive, screws or bolts which do not affect the smooth upper surfaces 26, 36 of the long board deck 15, or both and adhesive and mechanical attachment. The materials used are those commonly used in current long boards and are not novel or unique to the purpose of the folding long board. Thus, numerous variations on width and length are contemplated within the scope of this folding long board, including other optional features, including a tail fin on the rear section, perimeter reflectors, a variety of wheels within the wheel assemblies, springs and shocks for a smoother ride, and also a closure means 90 to maintain the folding long board in the folded position. These closure means 90 may include straps, clasps, elastic bands or even magnetic latch buttons 92 mounted or embedded within the bottom surfaces 52, 62 of the lower hinge blocks 50, 60 which have a strong attraction for one another when the long board is in the folded position with each magnetic latch button 92 making contact with one another, holding the front and rear sections 20, 30 together in the folded position.

It is also contemplated that other modification may present themselves as modification to the disclosed folding long board, which would allow for the same ability to make the long board compact and remain sturdy. These modifications are contemplated within the scope of this folding long board and could include locating the section between the front and rear section at another location, including at a distant where the front and rear board sections are equal with a front or rear wheel assembly being slidable forwards or backwards to allow it to be folded with the sections being parallel or with the front and rear wheel assemblies being rotatable for the same purpose. It is also possible to alter the locking means for the lower hinge blocks to either lock the long board in its elongated position, the folded position or one that provides the locking means in both. It is also contemplated that the long board may include more than one collapsing or folding location to further down size the overall profile for transport, with full expansion being made for use of the long board.

While the invention has been particularly shown and described with reference to a preferred embodiment thereof, it will be understood by those skilled in the art that changes in form and detail may be made therein without departing from the spirit and scope of the invention.

What is claimed is:

1. A folding long board used to transport a rider on a smooth surface, said folding long board comprising:

a front section having a front end, a rear joint margin, an upper surface and a lower surface, said lower surface attaching a top surface of a lower hinge support block along said rear joint margin and a front wheel assembly near said front end;

a rear section having a front joint margin, a rear end, an upper surface and a lower surface, said lower surface attaching a top surface of a lower hinge support block along said front joint margin and a rear wheel assembly near said rear end; and a hinged joint defining a hinge attached to respective bottom surfaces of said lower hinge support blocks, connecting said lower hinge support blocks and said front and rear sections and allowing for said front and rear sections to be placed into a folded position towards said respective lower surfaces while prohibiting movement of said hinge in the direction of said upper surfaces, wherein said upper surfaces of said front and rear sections form a contiguous horizontal long board deck when said folding long board is in an elongated position and wherein said front section and rear section are of unequal lengths so that when said front section and rear section are folded into said folded position, said wheel assemblies of said front and rear sections are offset and not in contact with said respective lower surfaces being parallel.

2. The folding long board as disclosed in claim 1, further comprising:

said lower hinge support block on said front section is further defined as having a rear abutment surface, said lower hinge support block on said rear section is further defined as having a front abutment surface, wherein said rear abutment surface and said front abutment surface is in proximal contact in said elongated position to prevent bending of said upper deck beyond a horizontal position under the weight of a rider.

3. The folding long board as disclosed in claim 1, further comprising:

said lower hinge support block on said front section is further defined as having a rear abutment surface and a front surface;

said lower hinge support block on said rear section is further defined as having a front abutment surface and a rear surface; and at least one longitudinal bore through each said lower hinge support block which would be in alignment when said folding long board is in said elongated position which is adapted to receive a common locking pin inserted completely through said aligned at least one longitudinal bore to further secure said folding long board into an elongated position, said common locking pin being removable when placing said folding long board into a folded position.

4. The folding long board as disclosed in claim 1, further comprising:

said lower hinge support block on said front section is further defined as having a rear abutment surface and a front surface;

said lower hinge support block on said rear section is further defined as having a front abutment surface and a rear surface;

at least two parallel longitudinal bores through each said lower hinge support block which would be in respective alignment when said folding long board is in said elongated position, each longitudinal bore adapted to receive a locking pin inserted completely through each respective longitudinal bore to further secure said folding long board into an elongated position, each said locking pin being removable when placing said folding long board into a folded position; and a lanyard attached between each said locking pin to be used as a carrying handle during transport of said folding long board in said folded position.

5. The folding long board as disclosed in claim 1, said lower hinge support blocks providing a closure means to maintain closure of said folding long board when in said folded position.

6. The folding long board as disclosed in claim 1, said bottom surfaces of said lower hinge support blocks further providing opposing charged respective embedded magnetic latch buttons aligning one another in said folded position and having strong magnetic attraction towards one another to maintain closure of said folding long board when in said folded position.

* * * * *